US010872741B2

(12) United States Patent
Shimono et al.

(10) Patent No.: US 10,872,741 B2
(45) Date of Patent: Dec. 22, 2020

(54) X-RAY TUBE

(71) Applicant: CANON ELECTRON TUBES & DEVICES CO., LTD., Otawara (JP)

(72) Inventors: Takashi Shimono, Nasushiobara (JP); Naoki Takahashi, Nasushiobara (JP)

(73) Assignee: CANON ELECTRON TUBES & DEVICES CO., LTD., Otawara (JP)

( * ) Notice: Subject to any disclaimer, the term of this patent is extended or adjusted under 35 U.S.C. 154(b) by 83 days.

(21) Appl. No.: 16/227,273

(22) Filed: Dec. 20, 2018

(65) Prior Publication Data

US 2019/0180970 A1 Jun. 13, 2019

Related U.S. Application Data

(63) Continuation of application No. PCT/JP2017/021449, filed on Jun. 9, 2017.

(30) Foreign Application Priority Data

Jun. 20, 2016 (JP) ..... 2016-121669

(51) Int. Cl.
*H01J 35/06* (2006.01)
*H01J 35/14* (2006.01)

(52) U.S. Cl.
CPC ..... *H01J 35/066* (2019.05); *H01J 35/064* (2019.05); *H01J 35/14* (2013.01)

(58) Field of Classification Search
CPC ..... H01J 35/06; H01J 35/14; H01J 2235/06; H01J 35/066; H01J 35/10; H01J 35/16; H01J 2235/068; H01J 35/064
See application file for complete search history.

(56) References Cited

U.S. PATENT DOCUMENTS 1,923,876 A 8/1933 Mutscheller
2,121,631 A * 6/1938 Gross et al. ..... H01J 35/101 378/134

(Continued)

FOREIGN PATENT DOCUMENTS

CN 1258378 A 6/2000
CN 1698174 A 11/2005

(Continued)

OTHER PUBLICATIONS

International Search Report dated Aug. 15, 2017 in PCT/JP2017/021449, filed on Jun. 9, 2017 (with English Translation).

(Continued)

*Primary Examiner* — Chih-Cheng Kao
(74) *Attorney, Agent, or Firm* — Oblon, McClelland, Maier & Neustadt, L.L.P.

(57) ABSTRACT

According to one embodiment, an x-ray tube includes a cathode and an anode. The cathode includes a filament coil and a focusing electrode that includes a valley bottom part, a first inclined plane rising from the valley bottom part and inclined in the direction of the anode, a first focusing groove, and a first receiving groove. The anode includes a target surface. θ1>0°. The filament coil, the first receiving groove, and the first focusing groove are positioned more to a third extended line side than a first reference plane. One end part of the first receiving groove is closer to the first reference plane than the other end part.

8 Claims, 14 Drawing Sheets

(56) References Cited

U.S. PATENT DOCUMENTS

| | | | | |
|---|---|---|---|---|
| 3,783,333 | A * | 1/1974 | Atlee | H01J 35/06 378/138 |
| 4,685,118 | A * | 8/1987 | Furbee | H01J 35/06 378/114 |
| 4,823,371 | A | 4/1989 | Grady | |
| 2015/0117617 | A1* | 4/2015 | Ishihara | H01J 35/14 378/138 |

FOREIGN PATENT DOCUMENTS

| | | | |
|---|---|---|---|
| CN | 104428865 | A | 3/2015 |
| FR | 732.173 | | 2/1932 |
| GB | 402385 | | 2/1932 |
| JP | 52-120556 | U | 9/1977 |
| JP | 60-192357 | U | 12/1985 |
| JP | 5-121020 | | 5/1993 |
| WO | WO 2014/007167 | A1 | 1/2014 |

OTHER PUBLICATIONS

Written Opinion dated Aug. 15, 2017 in PCT/JP2017/021449, filed on Jun. 9, 2017.

Korean Office Action issued Dec. 12, 2019 in Korean Patent Application No. 10-2018-7037646 (with English translation), citing document AO therein, 9 pages.

Extended European Search Report issued Jan. 29, 2020 in European Patent Application No. 17815212.0, citing documents AA and AB therein, 9 pages.

Combined Chinese Office Action and Search Report issued on Apr. 28, 2020, in Patent Application No. 201780037960.7 (with English translation), citing documents AO—AQ therein, 16 pages.

* cited by examiner

X-RAY TUBE

CROSS-REFERENCE TO RELATED APPLICATIONS

This application is a Continuation Application of PCT Application No. PCT/JP2017/021449, filed Jun. 9, 2017 and based upon and claiming the benefit of priority from Japanese Patent Application No. 2016-121669, filed Jun. 20, 2016, the entire contents of all of which are incorporated herein by reference.

FIELD

Embodiments described herein relate generally to an X-ray tube.

BACKGROUND

Generally, X-ray tubes are used for applications such as image diagnosis. A cathode of such an X-ray tube comprises two electron guns. Each of the electron guns includes a filament coil for emitting electrons and a focusing groove for focusing the emitted electrons. Two electron guns share one focusing electrode. The electrons emitted from each electron gun and then focused collide with a target surface of an anode target, and a focal spot is thereby formed on the target surface. Two electron guns are located with the focal spot in between so as to form a focal spot at the same position on the target surface, and are arranged so as to be inclined.

The target surface is inclined at an angle called a target angle in the main radiation direction. When viewed from a direction orthogonal to both the main radiation direction and the X-ray tube axis, the target surface and the surface on the side facing the target surface of the electron gun are inclined by approximately the target angle. Since the flight distance of electrons emitted from one of ends of the filament coil in the longitudinal direction and the flight distance of electrons emitted from the other end, are different from each other, the focal spot has a distorted shape. Therefore, in order to correct such distortion of the focal spot shape, a technique of inclining the whole electron gun to an appropriate angle with respect to the main radiation direction is known.

DETAILED DESCRIPTION

Figure 1:
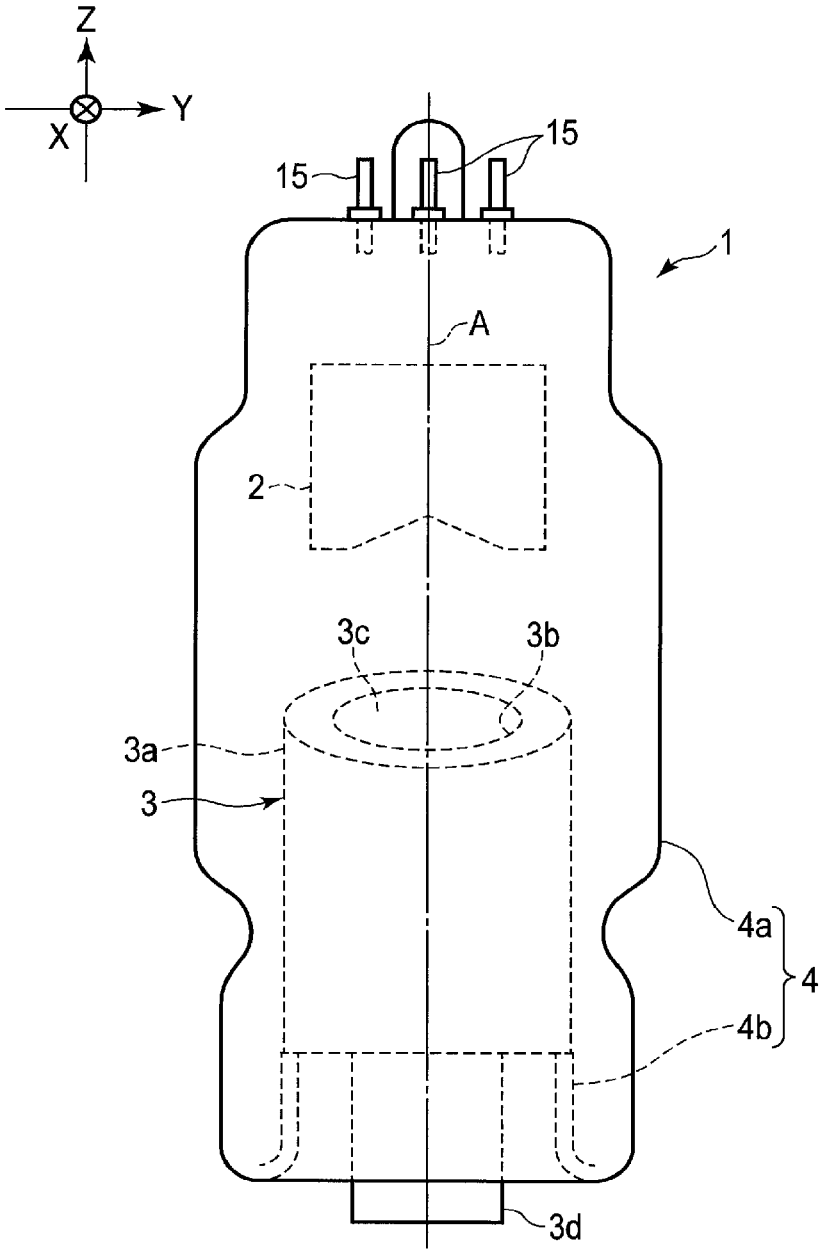
FIG. 1 is a schematic configuration diagram showing an X-ray tube according to an embodiment.

In general, according to one embodiment, there is provided an X-ray tube comprising:

an anode including a target surface radiating X-rays in a main radiation direction from a first focal spot formed by collision of an electron beam; and a cathode arranged at a position opposite to the target surface of the anode, and including a first filament emitting the electron beam and a focusing electrode focusing the electron beam emitted from the first filament, the focusing electrode including a valley bottom part farthest (with the shortest distance longest) from the first focal spot, a first inclined plane obliquely rising from the valley bottom part in the anode direction, a first focusing groove opened to the first inclined plane, and a first housing groove opened to the bottom surface of the first focusing groove to accommodate the first filament, wherein if an axis passing through a center of the first focal spot and parallel to an X-ray tube axis is a reference axis, a plane including the reference axis and the main radiation direction is a first reference plane, and an angle formed inside by a first extending line and a second extending line intersecting on a side opposite to a side of radiating the X-rays to the reference axis is referred to as a first angle $\theta 1$, where the first extending line is a virtual straight line extending from a boundary straight line between the valley bottom part and the first inclined plane along the first reference plane, and the second extending line is a virtual straight line extending from the target surface along the first reference plane and the target surface, $\theta 1 > 0°$ the first housing groove has a long axis, and the other end part of the first housing groove is closer to the first reference plane than one end part of the first housing groove on the first extending line side.

Embodiments will be described hereinafter with reference to the drawings. The disclosure is merely an example, and proper changes in keeping with the spirit of the invention, which are easily conceivable by a person of ordinary skill in the art, come within the scope of the invention as a matter of course. In addition, in some cases, in order to make the description clearer, the widths, thicknesses, shapes and the like, of the respective parts are illustrated schematically in the drawings, rather than as an accurate representation of what is implemented. However, such schematic illustration is merely exemplary, and in no way restricts the interpretation of the invention. In addition, in the specification and drawings, the same elements as those described in connection with preceding drawings are denoted by like reference numbers, and detailed description thereof is omitted unless necessary.

FIG. 1 is a schematic configuration diagram showing an X-ray tube 1 according to one embodiment.

As shown in FIG. 1, the X-ray tube 1 comprises a cathode 2, an anode 3, a vacuum envelope 4, and a plurality of pin assemblies 15. The cathode 2 includes a filament (electron emission source) for emitting electrons and a focusing electrode. In the present embodiment, the cathode 2 includes a first filament and a second filament. The plurality of pin assemblies 15 include, at least, two pin assemblies 15 for supplying a negative high voltage and a filament current to the first filament, two pin assemblies 15 for supplying a negative high voltage and a filament current to the second filament, and one pin assembly 15 for supplying a negative high voltage to the focusing electrode. The pin assembly 15 for the focusing electrode also comprises a function of supporting the focusing electrode and fixing the focusing electrode.

The anode 3 includes a target body 3*a* and an anode extending portion 3*d* connected to the target body 3*a*. The target body 3*a* includes a target layer 3*b* against which electrons collide. The surface of the target layer 3*b* on the side where electrons collide is a target surface 3*c*. The target body 3*a* is formed of a highly thermally conductive metal such as molybdenum (Mo), copper (Cu), an alloy thereof, or the like. The target layer 3*b* is formed of a metal having a melting point higher than that of the material used for the target body 3*a*. For example, the target body 3*a* is formed of copper or a copper alloy, and the target layer 3*b* is formed of a tungsten alloy. The anode extending portion 3*d* is formed in a columnar shape and uses copper or a copper alloy. The anode extending portion 3*d* fixes the target body 3*a*. The anode 3 emits X-rays as electrons emitted from the filament and focused by the focusing electrode impinge on the target surface 3*c*.

The vacuum envelope 4 includes a glass container 4*a* and a metal container 4*b*. The metal container 4*b* is airtightly connected to the glass container 4*a* on the one hand and airtightly connected to the anode 3 on the other. The glass container 4*a* is formed by using, for example, borosilicate glass. The glass container 4*a* can be formed by hermetically joining, for example, a plurality of glass members by melting. Since the glass container 4*a* has X-ray transparency, X-rays emitted from the anode 3 pass through the glass container 4*a* and are emitted to the outside of the vacuum envelope 4. The metal container 4*b* is airtightly fixed to at least one of the target body 3*a* and the anode extending portion 3*d*. The metal container 4*b* is airtightly connected to the target body 3*a* by brazing. In addition, the metal container 4*b* and the glass container 4*a* are airtightly connected by sealing. In the present embodiment, the metal container 4*b* is formed in an annular shape. In addition, the metal container 4*b* is formed by using Kovar.

The vacuum envelope 4 accommodates the cathode 2 and the target body 3*a*, and is formed such that the anode extending portion 3*d* is exposed. A plurality of pin assemblies 15 are airtightly attached to the vacuum envelope 4. Each of the pin assemblies 15 includes a cathode pin and the like and is located inside and outside the vacuum envelope 4.

The Z axis is an axis parallel to the X-ray tube axis A, the X axis is an axis orthogonal to the Z axis, and the Y axis is an axis orthogonal to both the X axis and the Z axis. A main radiation direction d of the X-rays which will be explained later is parallel to the X axis and the direction is opposite.

The voltage and current output from the power supply unit outside the X-ray tube 1 is supplied to the pin assembly 15 for filament and is consequently supplied to the filament. As a result, the filament emits electrons (thermal electrons). The power supply unit also supplies a predetermined voltage to the cathode 2 and the anode 3. In the present embodiment, a negative high voltage is applied to the cathode and a positive high voltage is applied to the anode 3. Since an X-ray tube voltage (tube voltage) is applied between the anode 3 and the cathode 2, the electrons emitted from the filament are accelerated and made incident on the target surface 3*c* as an electron beam. That is, the X-ray tube current (tube current) flows from the cathode 2 to the focal spot on the target surface 3*c*.

The focusing electrode serving as the cathode potential can focus electron beams (electrons) from the filament towards the anode 3.

The target surface 3*c* emits X-rays when an electron beam is made incident, and the X-rays emitted from the focal spot are transmitted through the vacuum envelope 4 and emitted to the outside of the X-ray tube 1.

Figure 2:
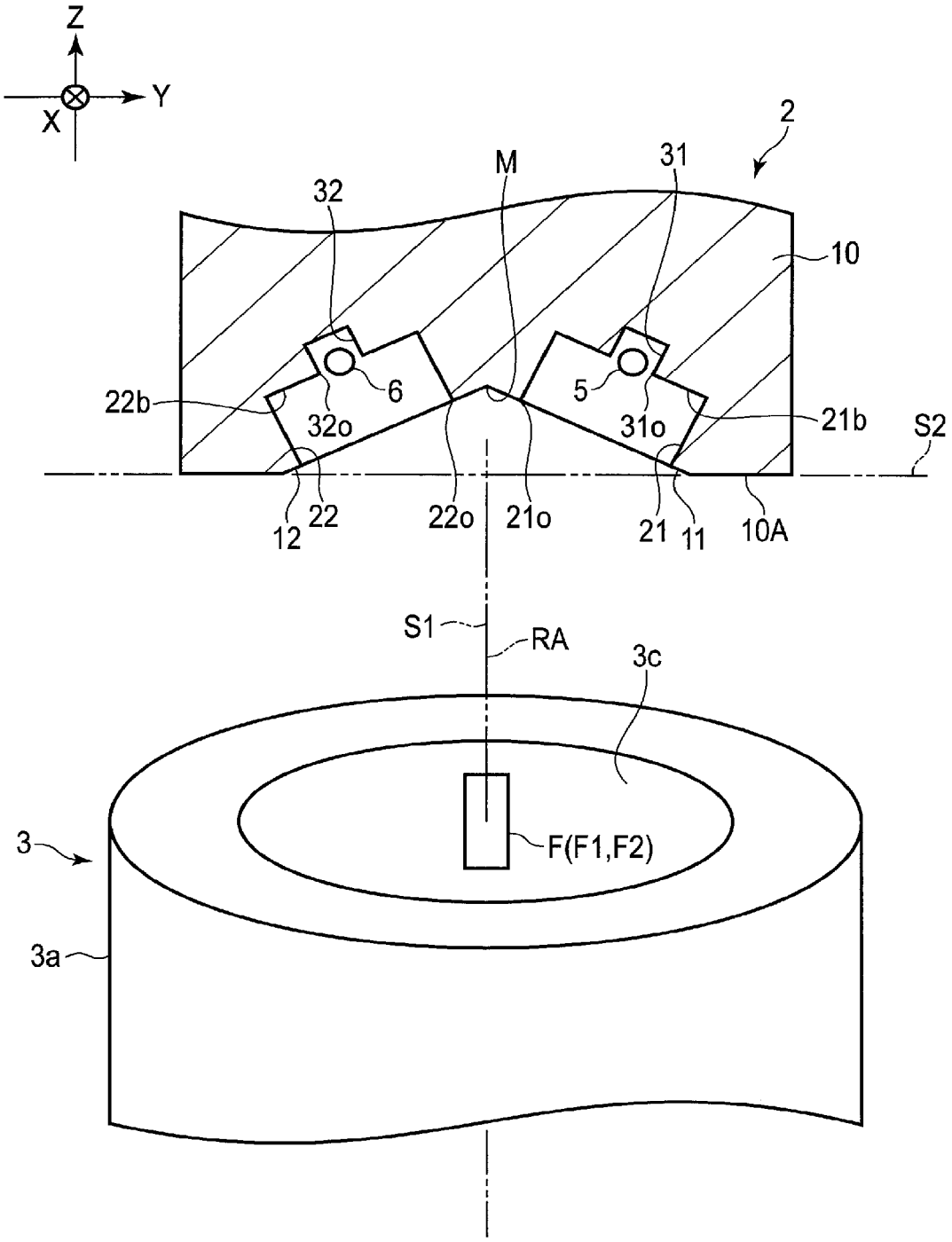
FIG. 2 is an enlarged view showing a cathode and an anode shown in FIG. 1.

FIG. 2 is an enlarged view of the cathode 2 and the anode 3 shown in FIG. 1. In the figure, the cathode 2 shows a cross-sectional shape along the Y-Z plane passing through a reference axis RA to be explained later, and the anode 3 shows a state seen from the front side.

As shown in FIG. 2, the cathode 2 includes a filament coil 5 as a first filament for emitting electrons, a filament coil 6 as a second filament for emitting electrons, and a focusing electrode 10 for focusing electrons emitted from the filament coil 5 and the filament coil 6. The focusing electrode 10 includes a flat front surface 10A, a first inclined plane 11, a first focusing groove 21, a first housing groove 31, a second inclined plane 12, a second focusing groove 22, and a second housing groove 32. When a boundary between the first inclined plane 11 and the second inclined plane 12 is referred to as a valley bottom part, the first inclined plane 11 and the second inclined plane 12 rise obliquely in the direction from the valley bottom part M to the anode 3. The valley bottom part M is a line segment parallel to the first reference plane S1 to be explained later.

The front surface 10A is closest to the anode 3, in the cathode 2 (focusing electrode 10). In this embodiment, the front surface 10A is parallel to the X-Y plane. However, the front surface 10A and the valley bottom part M may not be parallel to the X-Y plane.

The first inclined plane 11 and the second inclined plane 12 are inclined from the X-Y plane such that the two electron guns can form the focal spot F at the same position. The valley bottom part M is located on the X-Z plane passing through the reference axis RA.

The distance from the focal spot F to the valley bottom part M is longest of distances from the focal spot F to the first inclined plane 11 or the second inclined plane 12.

The first focusing groove 21 opens in the first inclined plane 11. The first housing groove 31 opens in the bottom surface 21*b* of the first focusing groove 21 and accommodates the filament coil 5. The second focusing groove 22 opens in the second inclined plane 12. The second housing groove 32 opens in the bottom surface 22*b* of the second focusing groove 22 and accommodates the filament coil 6.

The first inclined plane 11 is parallel to the bottom face 21*b* and the second inclined plane 12 is parallel to the bottom face 22*b*. For this reason, an opening 310 of the first housing groove 31 is parallel to an opening 210 of the first focusing groove 21, and an opening 32*o* of the second housing groove 32 is parallel to an opening 22*o* of the second focusing groove 22. The filament coil 5 extends along a virtual plane parallel to the opening 31*o*. The filament coil 6 extends along a virtual plane parallel to the opening 32*o*.

Of the focal spots F formed on the target surface 3*c*, a focal spot at which electrons emitted from the filament coil 5 are made incident on the target surface 3*c* and thereby irradiate X-rays in the main radiation direction is referred to as a first focal spot F1. On the other hand, a focal spot at which electrons emitted from the filament coil 6 are made incident on the target surface 3*c* to emit X-rays in the main radiation direction is referred to as a second focal spot F2. In the present embodiment, the center position of the first focal spot F1 and the center position of the second focal spot F2 are the same as each other. However, the dimension of the first focal spot F1 is different from the dimension of the second focal spot F2. This is because two electron guns are different in structure from each other, in the present embodiment. As will be explained later, for example, the dimensions of the filament coil 5 are different from the dimensions of the filament coil 6.

The reference axis RA is an axis passing through the center of the first focal spot F1 and parallel to the X-ray tube axis A. In the present embodiment, the reference axis RA is also an axis passing through the center of the second focal spot F2 and parallel to the X-ray tube axis A since the central positions of the first focal spot F1 and the second focal spot F2 are the same as each other. In addition, a plane including the reference axis RA and the main radiation direction is referred to as a first reference plane S1. A virtual plane located on the same plane as the front surface 10A is referred to as a second reference plane S2.

Figure 3:
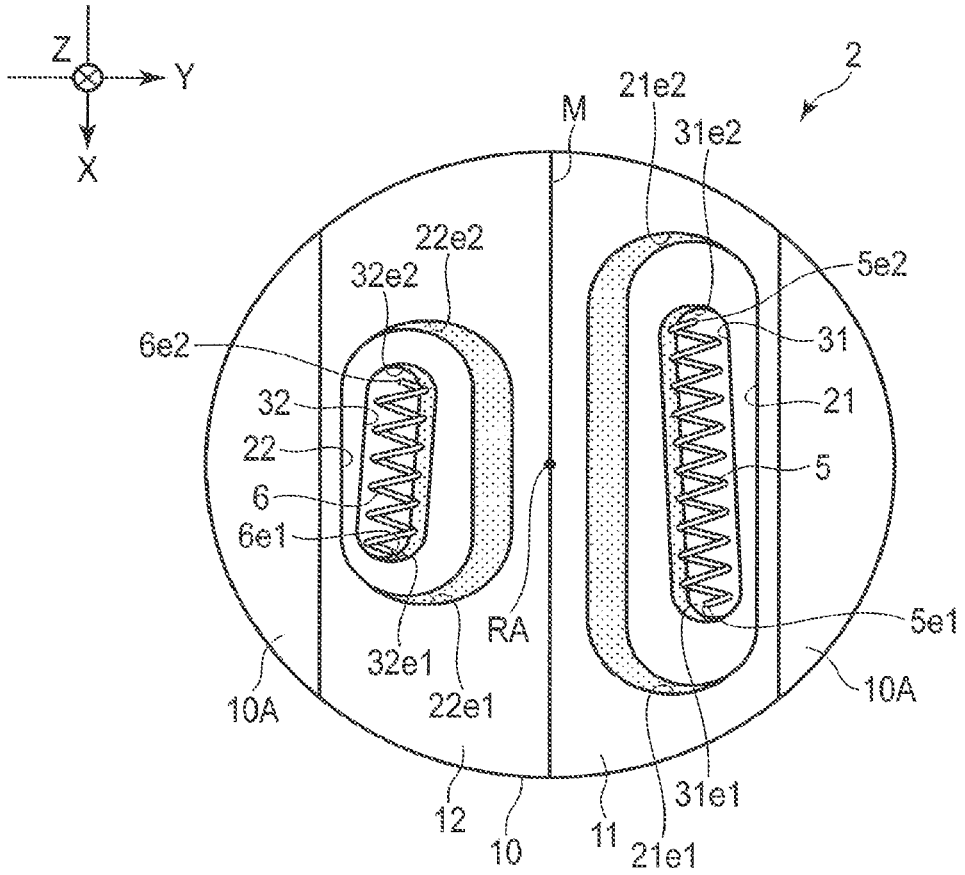
FIG. 3 is a plan view showing the cathode shown in FIG. 2.

FIG. 3 is a plan view showing the cathode 2 shown in FIG. 2, and is an X-Y plan view showing a state where the cathode 2 is viewed from the anode 3 side.

As shown in FIG. 3, the first focusing groove 21 has a long axis orthogonal to the reference axis RA and parallel to the first reference plane S1. Similarly, the second focusing groove 22 has a long axis orthogonal to the reference axis RA and parallel to the first reference plane S1. In addition, each of the first housing groove 31 and the second housing groove 32 has a long axis. Each of the filament coil 5 and the filament coil 6 is formed to extend in a straight line and has a long axis.

In the present embodiment, the long axis of each of the first housing groove 31 and the filament coil 5 is not parallel to the first reference plane S1. The long axis of each of the second housing groove 32 and the filament coil 6 is not parallel to the first reference plane S1.

The first focusing groove 21 has one end part 21*e*1 and the other end part 21*e*2. The first housing groove 31 has one end part 31*e*1 and the other end part 31*e*2. The filament coil 5 has one end part 5*e*1 and the other end part 5*e*2.

In addition, the second focusing groove 22 has one end part 22*e*1 and the other end part 22*e*2. The second housing groove 32 has one end part 32*e*1 and the other end part 32*e*2. The filament coil 6 has one end part 6*e*1 and the other end part 6*e*2.

Figure 4:
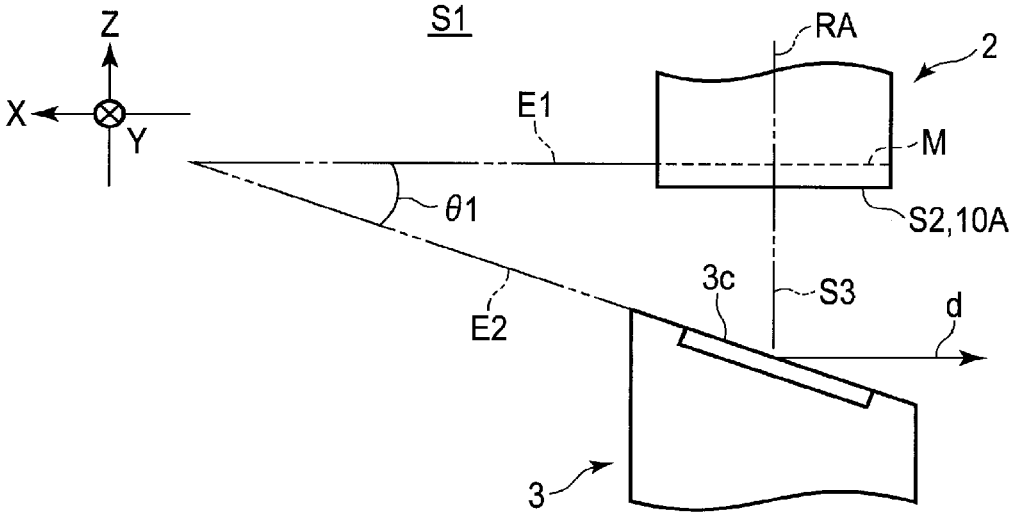
FIG. 4 is a view showing the cathode and the anode and is a view for explanation of a first angle.

FIG. 4 is a view showing the cathode 2 and the anode 3, and is a view for explanation of a first angle θ1. In the figure, the cathode 2 shows a state viewed from the front side, and the anode 3 shows a cross-sectional shape along the X-Z plane passing through the reference axis RA. In addition, the main radiation direction d of the X-rays and the like are shown in the figure.

The main radiation direction is a direction on the X-Z plane passing through the reference axis RA and a direction along the central axis of the available X-ray flux. In the present embodiment, the main radiation direction is perpendicular to the reference axis RA. In general, the shape of the focal spot formed on the target surface 3*c* as viewed from the outside of the X-ray tube 1 along the main radiation direction d which passes through the center of the focal spot and perpendicularly intersects the reference axis RA is called an effective focal spot.

As shown in FIG. 4, an angle formed by a first extending line E1 and a second extending line E2 intersecting the reference axis RA on the side opposite to the side radiating the X-rays is referred to as a first angle θ1. The first extending line E1 is a virtual straight line extending from the valley bottom part M (or, generally, the boundary line between the valley bottom part M and the first inclined plane 11) along the first reference plane S1. The second extending line E2 is a virtual straight line extending from the target surface 3*c* along the first reference plane S1 and the target plane 3*c*.

$\theta 1 > 0°$. In the present embodiment, the first angle θ1 is an acute angle ($0° < \theta 1 < 90°$). That is, the front surface 10A and the valley bottom part M are not parallel to the target surface 3*c*.

A plane including the reference axis RA and orthogonal to the first reference plane S1 is referred to as a third reference plane S3.

As shown in FIG. 3 and FIG. 4, based on the above description, the other end part 31*e*2 of the first housing groove 31 is closer to the first reference plane S1 than the one end part 31*e*1 of the first housing groove 31 on the side of the first extending line E1. In addition, the other end part 5*e*2 of the filament coil 5 is closer to the first reference plane S1 than the one end part 5*e*1 of the filament coil 5 on the side of the first extending line E1.

Similarly, the other end part 32*e*2 of the second housing groove 32 is closer to the first reference plane S1 than the one end part 32*e*1 of the second housing groove 32 on the side of the first extending line E1. In addition, the other end part 6*e*2 of the filament coil 6 is closer to the first reference plane S1 than the one end part 6*e*1 of the filament coil 6 on the side of the first extending line E1.

Figure 5:
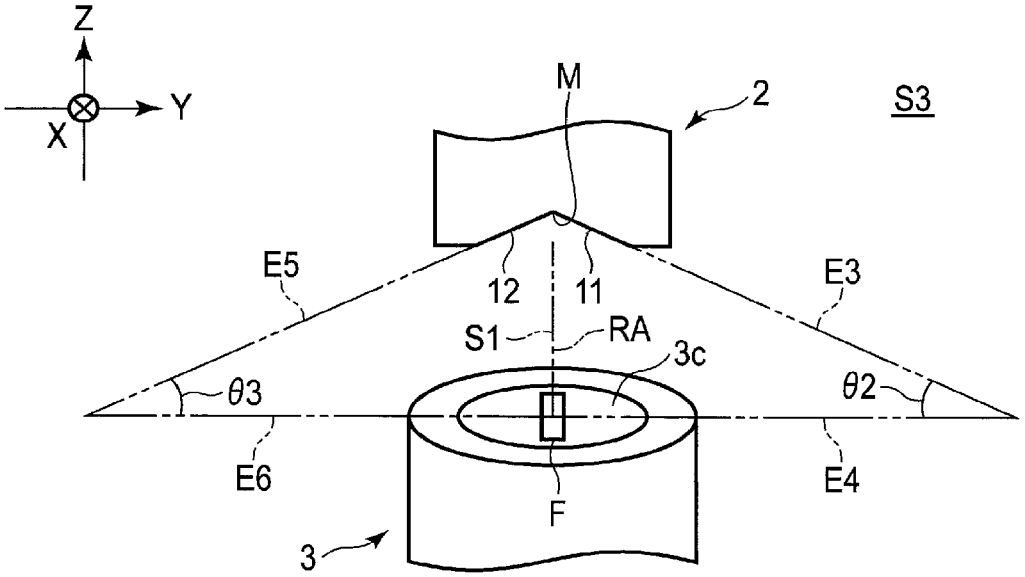
FIG. 5 is a front view showing the cathode and the anode and is a view for explanation of a second angle.

FIG. 5 is a front view showing the cathode 2 and the anode 3, and is a view for explanation of the second angle θ2 and the third angle θ3.

As shown in FIG. 5, an angle formed by a third extending line E3 and a fourth extending line E4 intersecting on the side viewed beyond the cathode 2 and the anode 3 from the reference axis RA is referred to as a second angle θ2. The third extending line E3 is a virtual straight line extending from the first inclined plane 11 along the third reference plane S3 and the first inclined plane 11. The fourth extending line E4 is a virtual straight line extending from the target surface 3*c* along the third reference plane S3 and the target plane 3*c*.

θ2>0°. In the present embodiment, the second angle θ2 is an acute angle (0°<θ2<90°).

Similarly, an angle formed by a fifth extending line E5 and a sixth extending line E6 intersecting on the side viewed beyond the cathode 2 and the anode 3 from the reference axis RA is referred to as a third angle θ3. The fifth extending line E5 is a virtual straight line extending from the second inclined plane 12 along the third reference plane S3 and the second inclined plane 12. The sixth extending line E6 is a virtual straight line extending from the target surface 3*c* along the third reference plane S3 and the target plane 3*c*.

θ3>0°. In the present embodiment, the third angle θ3 is an acute angle (0°<θ3<90°).

As shown in FIG. 2, FIG. 3, and FIG. 5, based on the above description, the filament coil 5, the first housing groove 31 and the first focusing groove 21 are positioned on the third extending line E3 side from the first reference plane S1. In contrast, the filament coil 6, the second housing groove 32 and the second focusing groove 22 are located on the fifth extending line E3 side from the first reference plane S1.

Figure 6:
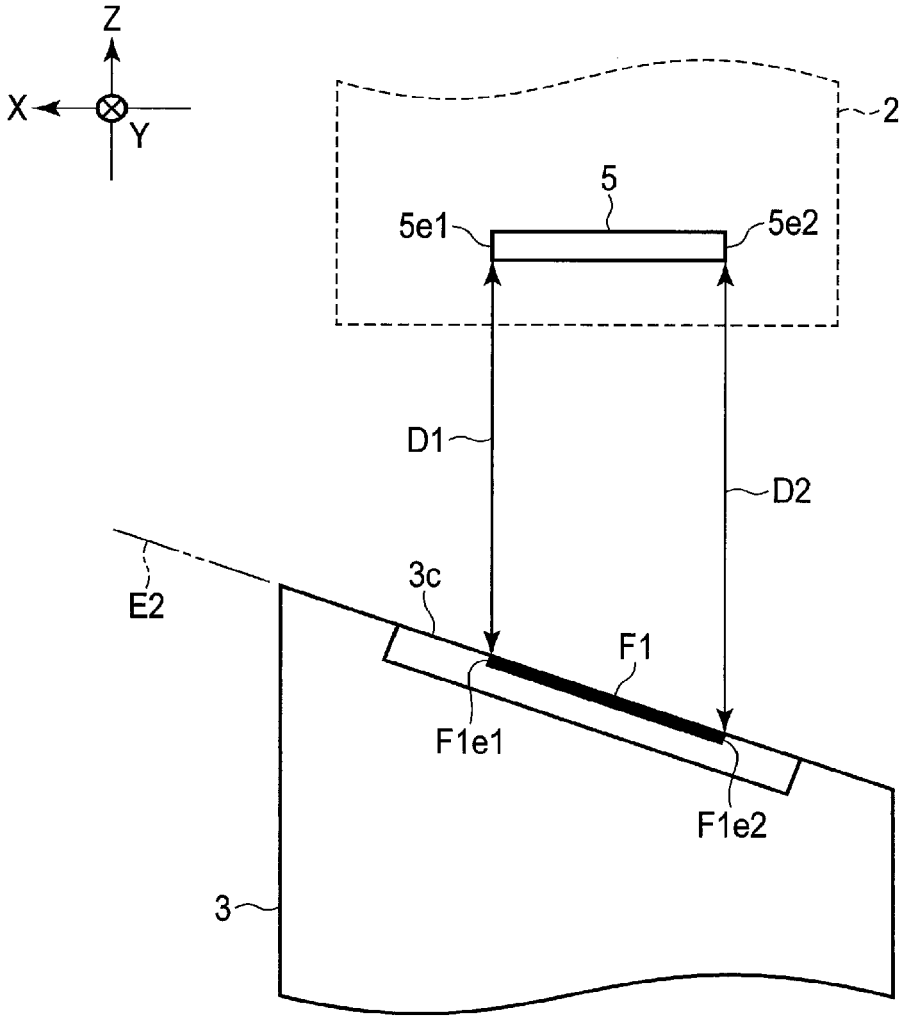
FIG. 6 is a view showing the cathode and the anode and is a view for explanation of a relationship between a first straight-line distance and a second straight-line distance.

FIG. 6 is a view showing the cathode 2 and the anode 3, and is a view for explanation of a relationship between a first straight-line distance D1 and a second straight-line distance D2.

As shown in FIG. 6, a straight-line distance from one end part 5*e*1 of the filament coil 5 to one end part F1*e*1 of the first focal spot F1 on the side of the second extending line E2 is referred to as a first straight-line distance D1. A straight-line distance from the other end part 5*e*2 of the filament coil 5 to the other end part F1*e*2 of the first focal spot F1 is referred to as a second straight-line distance D2. Then, D1<D2.

Figure 7:
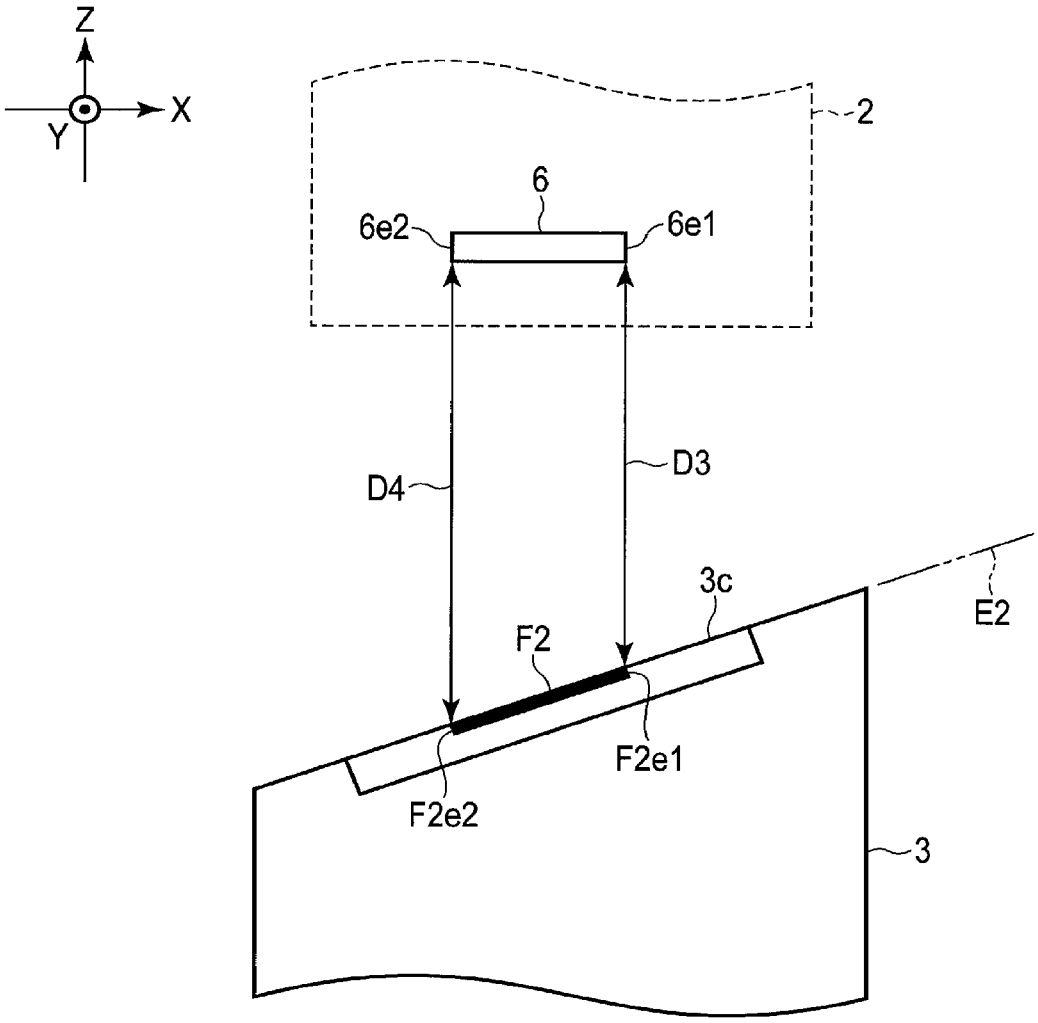
FIG. 7 is a view showing the cathode and the anode and is a view for explanation of a relationship between a third straight-line distance and a fourth straight-line distance.

FIG. 7 is a view showing the cathode and the anode, and is a diagram for explanation of the relationship between the third straight-line distance and the fourth straight-line distance.

As shown in FIG. 7, a straight-line distance from one end part 6*e*1 of the filament coil 6 to one end part F2*e*1 of the second focal spot F2 on the second extending line E2 side is referred to as a third straight-line distance D3. A straight-line distance from the other end part 6*e*2 of the filament coil 6 to the other end part F2*e*2 of the second focal spot F2 is referred to as a fourth straight distance-line D4. Then, D3<D4.

Figure 8:
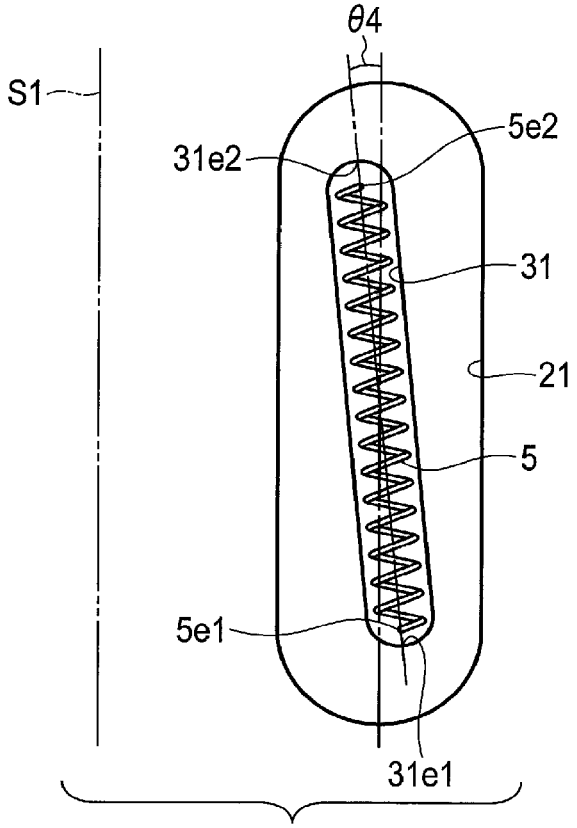
FIG. 8 is a view showing a filament coil, a first focusing groove, and a first housing groove perpendicularly projected on a virtual plane parallel to a first plane of the embodiment.

FIG. 8 is a view showing the filament coil 5, the first focusing groove 21, and the first housing groove 31 perpendicularly projected on the virtual plane parallel to the first inclined plane 11.

As shown in FIG. 8, the long axis of the first housing groove 31 is inclined from the long axis of the first focusing groove 21. The long axis of the filament coil 5 and the long axis of the first housing groove 31 are parallel to each other. In addition, as described above, the other end part 31*e*2 of the first housing groove 31 is closer to the first reference plane S1 than the one end part 31*e*1 of the first housing groove 31.

In the perpendicular projection view of FIG. 8, an angle at which the long axis of the first converging groove 21 intersects the long axis of the first accommodating groove 31 (filament coil 5) is referred to as a fourth angle θ4. In the present embodiment, the fourth angle θ4 is an acute angle (0°<θ4<90°).

Figure 9:
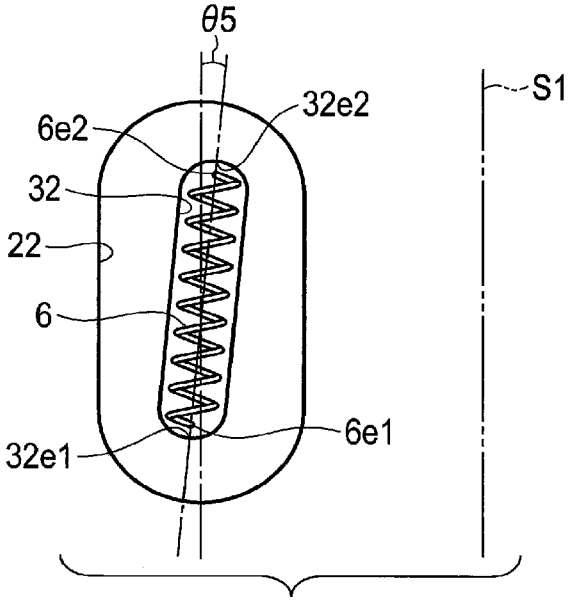
FIG. 9 is a view showing a filament coil, a second focusing groove, and a second housing groove perpendicularly projected on a virtual plane parallel to the second plane of the embodiment.

FIG. 9 is a view showing the filament coil 6, the second focusing groove 22, and the second housing groove 32 perpendicularly projected on a virtual plane parallel to the second inclined plane 12.

As shown in FIG. 9, the long axis of the second housing groove 32 is inclined from the long axis of the second focusing groove 22. The long axis of the filament coil 6 and the long axis of the second housing groove 32 are parallel to each other. In addition, as described above, the other end part 32*e*2 of the second housing groove 32 is closer to the first reference plane S1 than the one end part 32*e*1 of the second housing groove 32.

In the perpendicular projection view of FIG. 9, an angle at which the long axis of the second focusing groove 22 intersects the long axis of the second housing groove 32 (filament coil 6) is referred to as a fifth angle θ5. In the present embodiment, the fifth angle θ5 is an acute angle (0°<θ5<90°).

Next, results of simulations executed by the present inventors for emitting X-rays on the assumption that the X-ray tube 1 according to the present embodiment is used will be described. At this time, only the filament coil 5 of the plurality of filament coils was driven. For this reason, the focal spot formed on the target surface 3*c* was the first focal spot F1 and was a single focal spot. In addition, the simulation was executed under the same conditions.

More specifically, only the filament coil 5 was driven. The electrons emitted from the filament coil 5 are made incident on the target surface 3*c* as an electron beam. The electron beam is focused by the action of the electric field formed by the first focusing groove 21 of the focusing electrode 10. The positions and dimensions of a main focal spot formed by the electrons emitted from the upper surface (the surface on the target surface 3*c* side) of the filament coil 5 and the sub-focal spot formed by the electrons emitted from the side surface of the filament coil 5 substantially overlapped.

Various angles and distances are as follows.

θ1=16°

θ2=25°

θ4=2°

D1=13.3 mm

D2=16.7 mm

Figure 10:
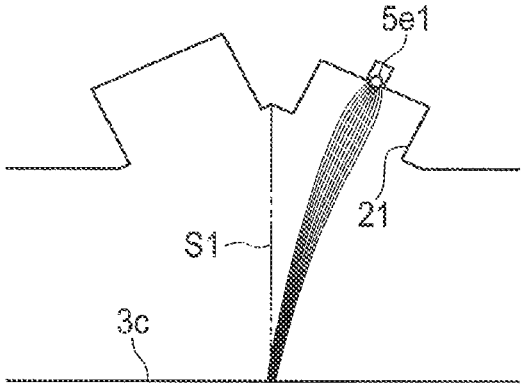
FIG. 10 is a view showing a state in which an electron beam is irradiated from an end portion of the filament coil of the embodiment toward a target surface by simulation.
Figure 11:
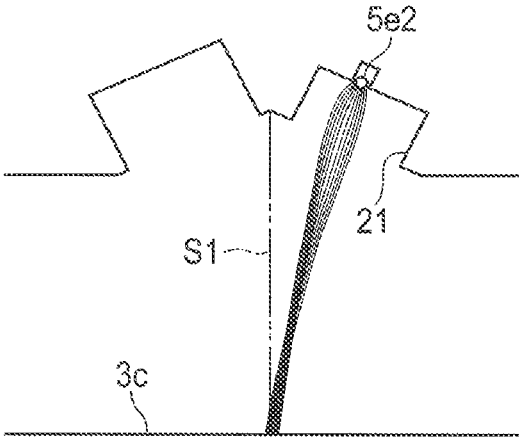
FIG. 11 is a view showing a state in which the electron beam is irradiated from the other end part of the filament coil of the embodiment to the target surface by the simulation.

FIG. 10 shows a state in which the electron beam is irradiated from one end part 5*e*1 of the filament coil 5 toward the target surface 3*c* by simulation. FIG. 11 is a view showing a state in which the electron beam is irradiated from the other end part 5*e*2 of the filament coil 5 toward the target surface 3*c* by simulation.

As can be understood from FIG. 10 and FIG. 11, the focal spot formed by the electrons emitted from the one end part 5*e*1 and the focal spot formed by the electrons emitted from the other end part 5*e*2 are located on the first reference plane S1.

Figure 12:
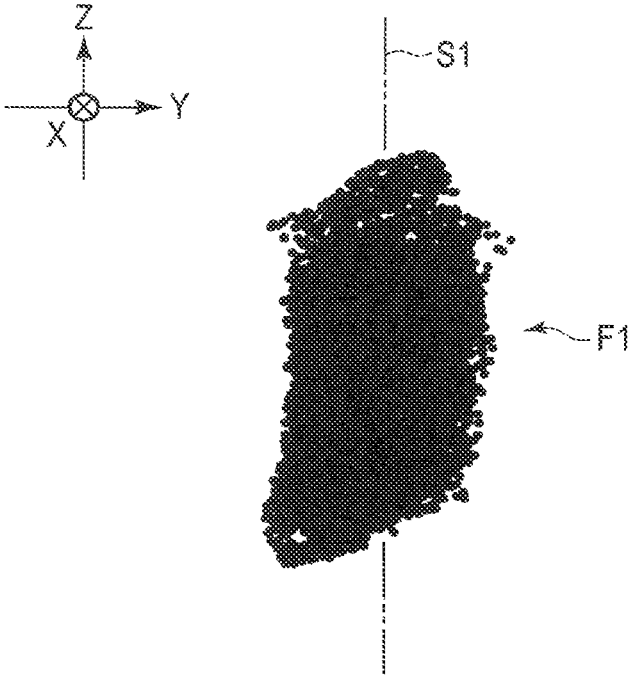
FIG. 12 is a view showing an image of a first focal spot formed on the target surface of the embodiment by the simulation.

FIG. 12 is a diagram showing an image of the first focal spot F1 formed on the target surface 3*c* by simulation. The image of the first focal spot F1 is a shape viewed from the outside of the X-ray tube 1 along the main radiation direction d, that is, an effective focal spot.

As shown in FIG. 12, it can be understood that the increase in width of the first focal spot F1 is suppressed in the direction orthogonal to the first reference plane S1.

According to the X-ray tube 1 of the embodiment configured as described above, the X-ray tube 1 comprises a cathode 2 and an anode 3. The cathode 2 includes a filament coil 5, and a focusing electrode 10 including a front surface 10A, a first inclined plane 11, a first focusing groove 21 and a first housing groove 31. The anode 3 has a target surface 3*c*.

θ1>0° and θ2>0°. The filament coil 5, the first housing groove 31, and the first focusing groove 21 are located on the third extending line E3 side from the first reference plane S1. The other end part 31*e*2 of the first housing groove 31 is closer to the first reference plane S1 than the one end part 31*e*1 on the first extending line E1 side of the first housing groove 31.

The distortion of the shape of the first focal spot F1 can be thereby corrected. That is, the distortion of the shape of the first focal spot F1 can be suppressed as compared with a case where θ4=0°. In this case, the above effect can be obtained without increasing the outer diameter of the focusing electrode 10. In addition, the above effect can be obtained without tilting the long axis of the first focusing groove 21. Based on the above, the X-ray tube 1 which is small in size and can reduce the distortion of the focal spot shape can be obtained.

Figure 13:
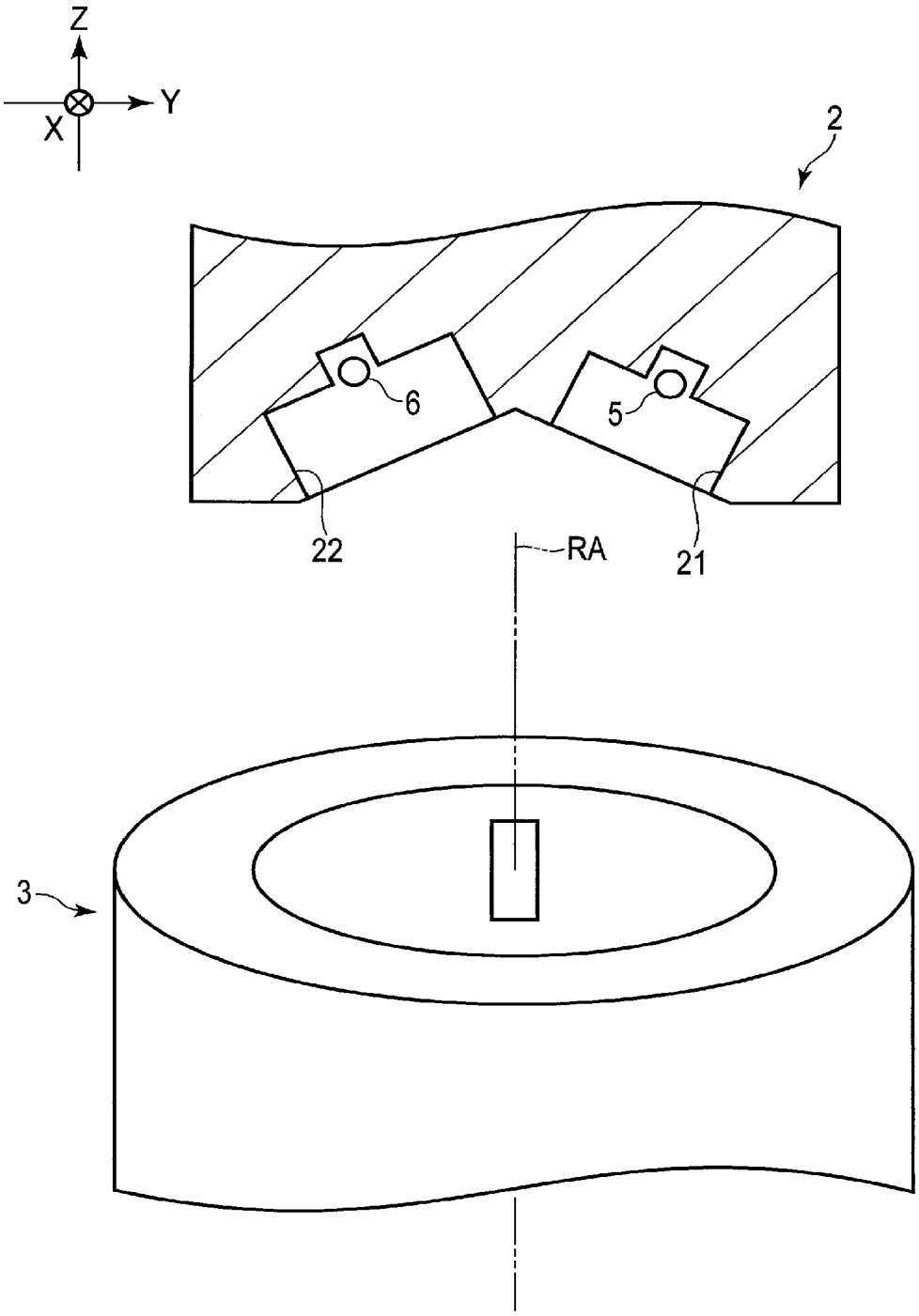
FIG. 13 is an enlarged view of the cathode and the anode, showing a state in which the second focusing groove is formed to be larger than the first focusing groove.

Next, results of investigations on the fourth angle θ4 and the fifth angle θ5 executed by the present inventors will be explained. FIG. 13 is an enlarged view of the cathode 2 and the anode 3, showing a state in which the second focusing groove 22 is formed to be larger than the first focusing groove 21.

As shown in FIG. 13, the second focusing groove 22 is larger than the first focusing groove 21. Attention is paid to the first angle θ1, the second angle θ2, and the fourth angle θ4.

When θ2=25° and θ1=20°, it is desirable that θ4=4.4°.

When θ2=25° and θ1=5°, it is desirable that θ4=1.0°.

When θ2=25° and θ1=2.5°, it is desirable that θ4=0.5°.

Next, attention is paid to the first angle θ1, the third angle θ3, and the fifth angle θ5.

When θ3=25° and θ1=20°, it is desirable that θ5=5.2°.

When θ3=25° and θ1=5°, it is desirable that θ5=1.3°.

When θ3=25° and θ1=2°, it is desirable that θ5=0.5°.

The second angle θ2 depends on the length of the first straight-line distance D1, the length of the second straight-line distance D2, and the size of the first focusing groove 21. The third angle θ3 depends similarly to the second angle θ2. The case where each of the second angle θ2 and the third angle θ3 is 25° has been explained as an example, but the angles are not limited to these and can be variously modified. For example, the second angle θ2 and the third angle θ3 may be approximately 20°.

Based on the above, the fourth angle θ4 becomes smaller as the second angle θ2 is smaller. The fifth angle θ5 becomes smaller as the third angle θ3 is smaller. In addition, the fourth angle θ4 becomes larger as the first focusing groove 21 is larger. The fifth angle θ5 becomes larger as the second focusing groove 22 is larger.

An optimum value of the fourth angle θ4 exists depending on the magnitude of the first angle θ1, the magnitude of the second angle θ2, the length of the first straight-line distance D1, the length of the second straight-line distance D2, and the size of the first focusing groove 21. Similarly, an optimum value of the fifth angle θ5 exists depending on the magnitude of the first angle θ1, the magnitude of the third angle θ3, the length of the third straight-line distance D3, the length of the fourth straight-line distance D4, and the size of the second focusing groove 22. For example, each of the fourth angle θ4 and the fifth angle θ5 is desirably selected from the range of 0.5° to 5°.

The upper limit value of the fourth angle θ4 is a value at which the first housing groove 31 interferes with the first focusing groove 21. For example, in FIG. 8, when θ4=20°, the first housing groove 31 interferes with the first focusing groove 21 in a case where the width of the first focusing groove 21 (i.e., the length of the first focusing groove 21 in the direction orthogonal to the long axis) is 6 mm, the width of the first housing groove 31 (i.e., the length orthogonal to the long axis of the first housing groove 31) is 1.5 mm, and the length of the first housing groove 31 (i.e., the length of the long axis of the first housing groove 31) is 12 mm.

Figure 15:
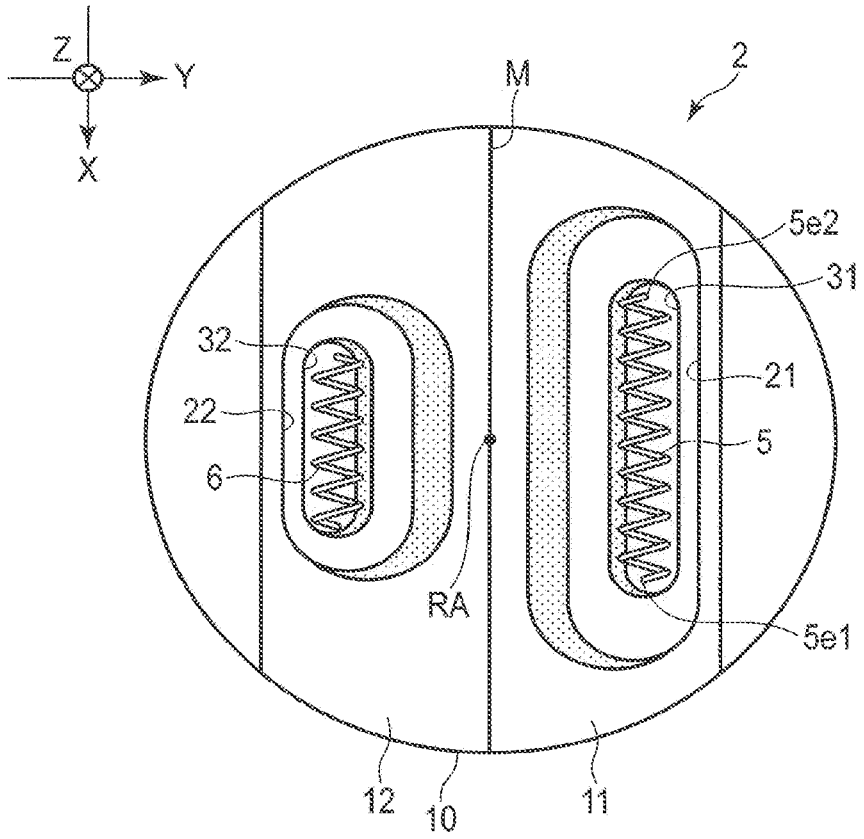
FIG. 15 is a plan view showing the cathode of the X-ray tube according to a comparative example.

Next, the X-ray tube of a comparative example will be explained for comparison with the X-ray tube 1 according to the above embodiment. FIG. 15 is a plan view showing the cathode 2 of the X-ray tube according to the comparative example.

As shown in FIG. 15, each of the long axis of the filament coil 5, the long axis of the first focusing groove 21, and the long axis of the first housing groove 31 is perpendicular to the reference axis RA and parallel to the first reference plane S1. Similarly, each of the long axis of the filament coil 6, the long axis of the second focusing groove 22, and the long axis of the second housing groove 32 is orthogonal to the reference axis RA and parallel to the first reference plane S1. θ4=0° and θ5=0°. The X-ray tube according to the comparative example is different from the X-ray tube 1 according to the above embodiment with respect to the above matter.

Figure 16:
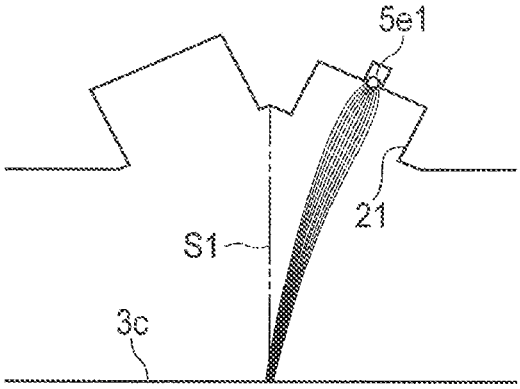
FIG. 16 is a view showing a state in which an electron beam is irradiated from one end part of the filament coil of the comparative example toward the target surface by simulation.
Figure 17:
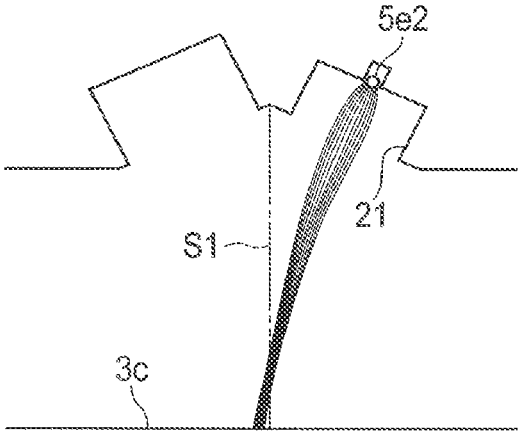
FIG. 17 is a view showing a state in which the electron beam is irradiated from the other end part of the filament coil of the comparative example toward the target surface by the simulation.

FIG. 16 is a view showing a state in which the electron beam is irradiated from one end part 5*e*1 of the filament coil 5 of the comparative example toward the target surface 3*c* by simulation. FIG. 17 is a view showing a state in which the electron beam is irradiated from the other end part 5*e*2 of the filament coil 5 of the comparative example toward the target surface 3*c* by simulation.

As can be understood from FIG. 16 and FIG. 17, the focal spot formed by the electrons emitted from the one end part 5*e*1 is located on the first reference plane S1, but the focal spot formed by the electrons emitted from the other end part 5*e*2 is not located on the first reference plane S1.

Figure 18:
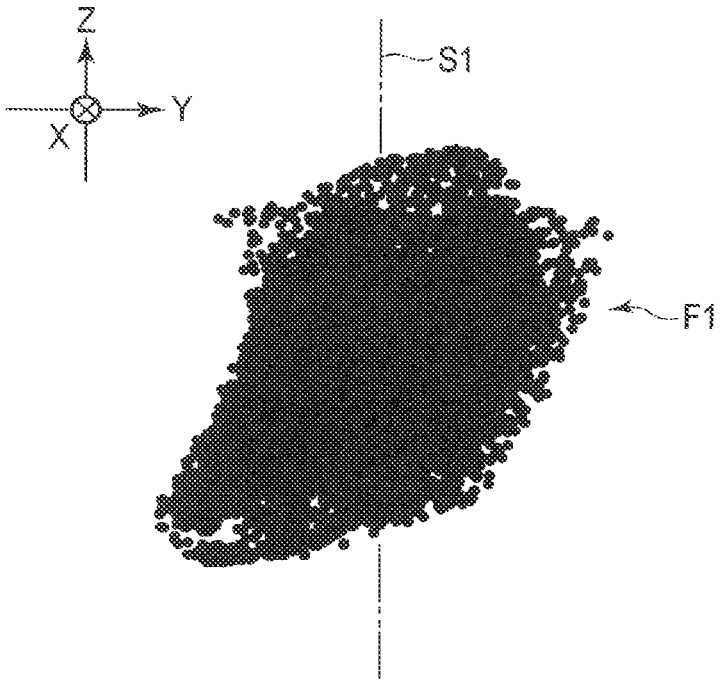
FIG. 18 is a view showing an image of the first focal spot formed on the target surface of the comparative example by the simulation.

FIG. 18 is a view showing an image of the first focal spot F1 formed on the target surface 3*c* of the comparative example by simulation. The image of the first focal spot F1 is a shape viewed from the outside of the X-ray tube 1 along the main radiation direction d, that is, an effective focal spot.

As shown in FIG. 18, it can be understood that suppressing the increase in the width of the first focal spot F1 in the direction orthogonal to the first reference plane S1 is difficult.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

Figure 14:
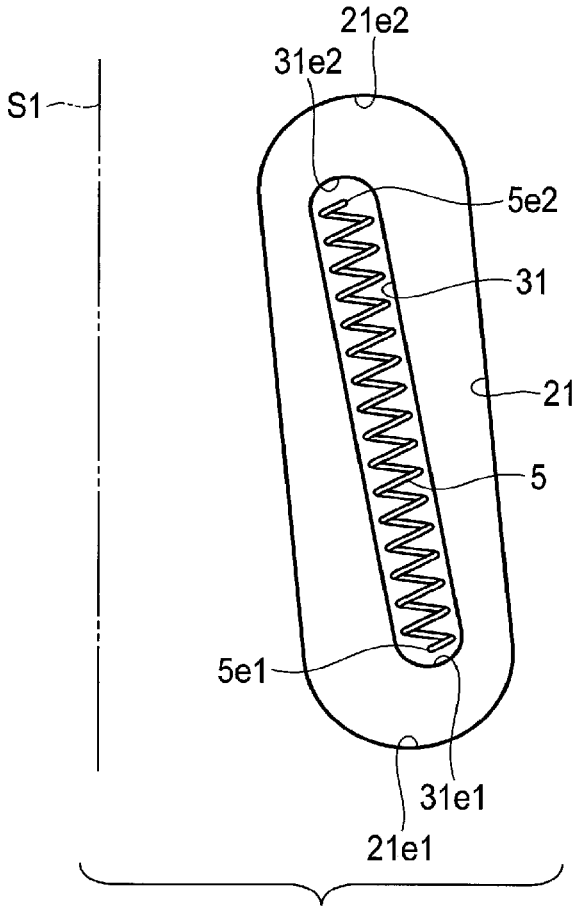
FIG. 14 is a view showing a filament coil, a first focusing groove and a first housing groove perpendicularly projected on a virtual plane parallel to the first plane in the X-ray tube according to a modified example of the embodiment.

For example, FIG. 8 of the above embodiment shows the example that the first focusing groove 21 is not inclined is exemplified and FIG. 9 shows the example that the second focusing groove 22 is not inclined, but the invention is not limited to these. For example, as shown in FIG. 14, not only the filament coil 5 and the first housing groove 31 but also the first focusing groove 21 may be inclined. In this case, the other end part 21*e*2 of the first focusing groove 21 is closer to the first reference plane S1 than the one end part 21*e*1 on the side of the first extension line E1 of the first focusing groove 21. The long axis of the first housing groove 31 is inclined from the long axis of the first focusing groove 21 ($0° < \theta 4 < 90°$).

If the X-ray tube 1 includes a plurality of electron guns, the housing groove (filament coil) of at least one electron gun of the X-ray tube 1 may be inclined as shown in FIG. 8, FIG. 9, and FIG. 14.

For this reason, the X-ray tube 1 may be provided with a housing groove (filament coil) which is not inclined as shown in FIG. 15.

In addition, the example that the valley bottom part M is linear is explained in the above embodiment, but the valley bottom part M may be a flat surface perpendicular to the first reference plane S1. In this case, the flat valley bottom part M may be provided with a non-inclined focusing groove and a non-inclined housing groove (filament coil) as shown in FIG. 15.

Furthermore, the example that the focusing electrode 10 includes the flat front surface 10A is explained in the above embodiment, but the flat front surface 10A may not be present.

Embodiments of the present invention are not limited to the above-explained stationary anode X-ray tube 1 but can be applied to various types of stationary anode X-ray tubes, rotation anode X-ray tubes, and other X-ray tubes.

What is claimed is:

1. An X-ray tube, comprising:

an anode including a target surface radiating X-rays in a main radiation direction from a first focal spot formed by collision of an electron beam; and a cathode arranged at a position opposite to the target surface of the anode, and including a first filament emitting the electron beam and a focusing electrode focusing the electron beam emitted from the first filament, the focusing electrode including a valley bottom part farthest from the first focal spot, a first inclined plane obliquely rising from the valley bottom part in a direction to the anode, a first focusing groove opened to the first inclined plane, and a first housing groove opened to the bottom surface of the first focusing groove to accommodate the first filament, wherein an axis passing through a center of the first focal spot and parallel to an X-ray tube axis is a reference axis, a plane including the reference axis and the main radiation direction is a first reference plane, and an angle formed inside by a first extending line and a second extending line intersecting on a side opposite to a side of radiating the X-rays with respect to the reference axis is referred to as a first angle θ1, where the first extending line is a virtual straight line extending from a boundary straight line between the valley bottom part and the first inclined plane along the first reference plane, and the second extending line is a virtual straight line extending from the target surface along the first reference plane and the target surface, $\theta 1 > 0°$ the first housing groove has a long axis, the first focusing groove has a lone axis, and the long axis of the first housing groove is inclined from the long axis of the first focusing groove.

2. The X-ray tube of claim 1, wherein the valley bottom part is a line segment parallel to the first reference plane.

3. The X-ray tube of claim 1, wherein an opening of the first housing groove is parallel to an opening of the first focusing groove, and the first filament extends along a virtual plane parallel to the opening of the first focusing groove.

4. The X-ray tube of claim 1, wherein the first filament has a long axis, and a first straight-line distance from one end part of the first filament on the first extending line side to one end part of the first focal spot on the second extending line side is referred to as D1, and a second straight-line distance from the other end part of the first filament to the other end part of the first focal spot is referred to as D2, $D1 < D2$.

5. The X-ray tube of claim 1, wherein the long axis of the first focusing groove has is a orthogonal to the reference axis and is parallel to the first reference plane.

6. The X-ray tube of claim 1, wherein the first filament has a long axis, and the long axis of the first filament and the long axis of the first housing groove are parallel to each other.

7. The X-ray tube of claim 1, wherein the other end part of the first focusing groove is closer to the first reference plane than one end part of the first focusing groove of the first extending line side.

8. The X-ray tube of claim 1, wherein the other end part of the first housing groove is closer to the first reference plane than one end part of the first housing groove on the first extending line side.

* * * * *